US007681294B2

(12) United States Patent
Payne

(10) Patent No.: US 7,681,294 B2
(45) Date of Patent: Mar. 23, 2010

(54) METAL FENCE PICKET STAKING APPARATUS AND METHOD

(76) Inventor: Danny Scott Payne, 1807 N. Business Hwy. 287, Decatur, TX (US) 76234

( * ) Notice: Subject to any disclaimer, the term of this patent is extended or adjusted under 35 U.S.C. 154(b) by 1310 days.

(21) Appl. No.: 11/158,948

(22) Filed: Jun. 21, 2005

(65) Prior Publication Data

US 2005/0283966 A1 Dec. 29, 2005

Related U.S. Application Data

(60) Provisional application No. 60/582,189, filed on Jun. 23, 2004.

(51) Int. Cl.
*B23Q 3/00* (2006.01)
*B21D 47/01* (2006.01)
*B21D 19/12* (2006.01)
*E04H 17/00* (2006.01)

(52) U.S. Cl. ..... 29/464; 29/897.33; 72/48; 235/65.01

(58) Field of Classification Search ..... 29/464, 29/465, 466, 897.33; 72/48; 256/65.01, 256/21, 22, 59, 65.12, 65.02, 65.11
See application file for complete search history.

(56) References Cited

U.S. PATENT DOCUMENTS 942,039 A 11/1909 McClure
1,993,536 A 3/1935 Turner et al. ..... 256/22
3,787,033 A 1/1974 Snyder et al. ..... 256/59
3,822,053 A 7/1974 Daily ..... 256/22
3,848,855 A 11/1974 Weiland ..... 256/73
5,224,256 A 7/1993 Haglund ..... 29/523
5,581,868 A 12/1996 Bisch ..... 29/525.08
6,631,887 B1 * 10/2003 Walmsley ..... 256/22
6,739,583 B2 * 5/2004 Ryon ..... 256/65.02
6,824,123 B2 * 11/2004 Larsen et al. ..... 256/65.01
2003/0209700 A1 11/2003 Gibbs ..... 256/22

* cited by examiner

*Primary Examiner*—John C Hong
(74) *Attorney, Agent, or Firm*—Guy V. Manning

(57) ABSTRACT

A plurality of staking die sets is provided, each adapted to crimp an iron fence rail onto a picket where the latter passes through an aperture in the former. Each die set comprises a staking die matching the cross sectional shape of the picket and adapted to embrace one half of the picket on one side of the rail. A corresponding anvil die opposes the staking die on the opposite side of the rail. Mechanically leveraged, powered jaws force the staking die toward the anvil and against the rail to squeeze the rail in the immediate vicinity of the picket, causing rail metal around the aperture to flow toward the picket, reducing the aperture until the picket becomes immobilized. A plurality of such jaws and dies, adjustably arrayed at selected spacings and coupled to a common power source, allows a single staking operation to affix simultaneously all pickets in a given length of rail. Multiple arrays of jaws and dies may be arranged in parallel for simultaneously staking a like number of rails to the pickets to form an entire fence panel in a single powered operation. A novel method of fabricating an iron fence panel in a single operation includes arranging such jaws in a two dimensional array for staking multiple pickets to multiple rails in a single power operation.

20 Claims, 5 Drawing Sheets

METAL FENCE PICKET STAKING APPARATUS AND METHOD

This application is a continuation-in-part of Provisional Application Ser. No. 60/582,189 filed Jun. 23, 2004.

BACKGROUND OF THE INVENTION

1. Field of the Invention

This invention relates generally to construction of iron fencing, and particularly to attachment of vertical iron pickets to horizontal supporting rails. More particularly, this invention relates to apparatus and method for simultaneous non-thermal attachment of multiple pickets to rails to create an entire fence panel in one operation.

2. Description of Related Art

Iron fences have been manufactured literally for centuries. Methods for attaching pickets to supporting rails, however, have varied over time. In the $19^{th}$ century, the predominant method involved hand staking, where two men used a hammer or maul to pound a die against a supporting rail where it surrounded a picket. One worker wielded the maul while the other supported the rail and picket, holding an anvil against the top of the rail to confine it and to encourage crimping of rail material against the picket. Each attachment point between picket and rail had to be worked individually. This very labor intensive and time consuming procedure became largely obsolete for most iron fence projects once welding became common. A less labor intensive means of staking pickets to rails, however, would make commercially practicable an aesthetically preferable manner of fabricating iron fences.

When welding became generally available, it also became the prevalent practice in attaching iron fence pickets to rails. The components of a fence panel would be laid out on a jig while they were tack welded at each contact point, usually on the bottom of the rail where the welding would be the least unsightly. Regardless of how well welding is performed, however, it produces significant unsightliness, risks warping the rail and still requires one or more skilled welders to attach each picket to each rail one operation at a time. Means for fabricating iron fences without welding would improve appearance and reduce costs.

SUMMARY OF THE INVENTION

Accordingly, it is an object of this invention to provide means of coupling pickets to rails that produces a less unsightly joinder than does welding.

It is another object of this invention to provide means for attaching pickets to rails employing more aesthetically pleasing staking methods.

It is another object of this invention to provide efficient manufacturing apparatus and methods for fabricating iron fence panels.

It is yet another object of this invention to provide apparatus and means for simultaneously staking multiple attachment points between pickets and rails.

The foregoing and other objects of this invention are achieved by providing a plurality of staking die set, each adapted to crimp an iron fence rail onto a picket where the latter passes through an aperture in the former. Each die set comprises a staking die matching the cross sectional shape of the picket and adapted to embrace one half of the picket on one side of the rail. A corresponding anvil die opposes the staking die on the opposite side of the rail. Mechanically leveraged, powered jaws force the staking die toward the anvil and against the rail to squeeze the rail in the immediate vicinity of the picket, causing rail metal around the aperture to flow toward the picket, reducing the aperture until the picket becomes immobilized. A plurality of such jaws and dies, adjustably arrayed at selected spacings and coupled to a common power source, allows a single staking operation to affix simultaneously all pickets in a given length of rail. Multiple arrays of jaws and dies may be arranged in parallel for simultaneously staking a like number of rails to the pickets to form an entire fence panel in a single powered operation. A novel method of fabricating an iron fence panel in a single operation includes arranging such jaws in a two dimensional array for staking multiple pickets to multiple rails in a single power operation.

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
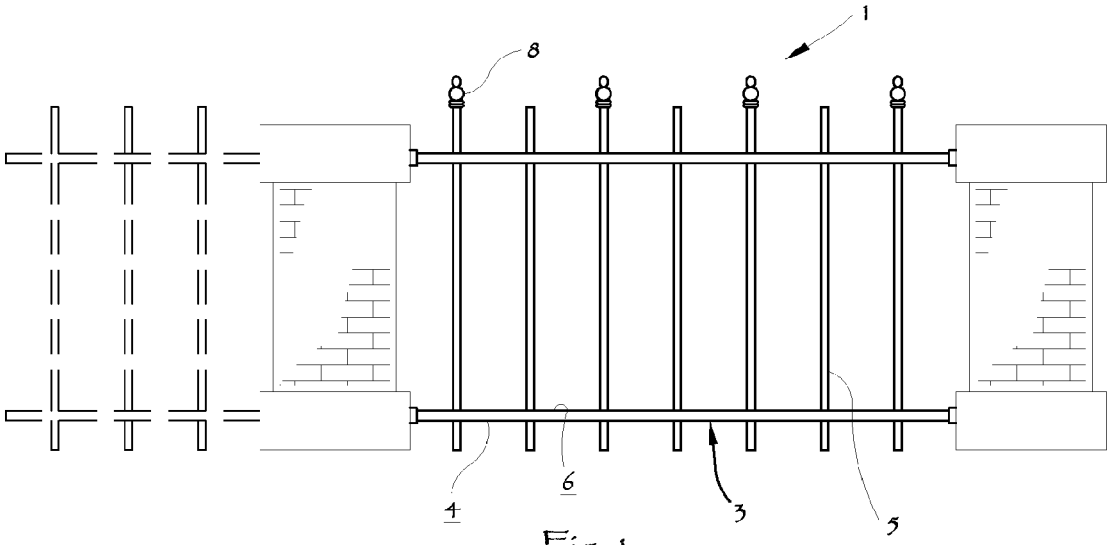
Fig. 1 (Prior Art)
FIG. 1 depicts an fence section having a panel with two rails and multiple pickets fabricated using the tools and methods of the present invention.
Figure 2:
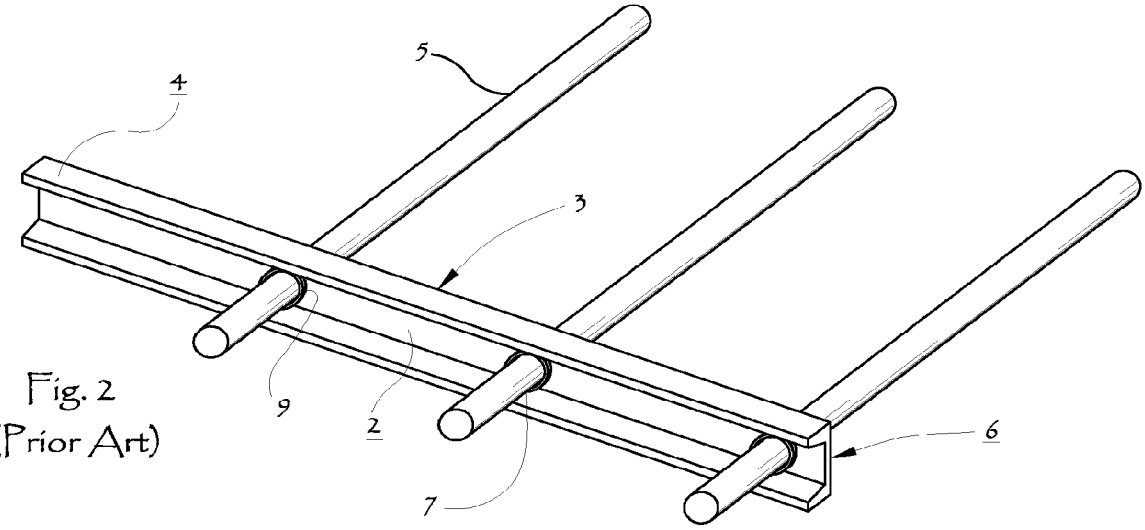
Fig. 2 (Prior Art)
FIG. 2 details the bottom of one of the rails of the panel of FIG. 1, showing the clean staking marks at each picket.

With reference now to the figures, and in particular to FIGS. 1-2, iron fence panel 1 comprises vertical pickets 5 held in regular, horizontally spaced relation to each other by supporting rails 3. Pickets 5 may be topped by decorative finials 8. Rail 3 typically comprises a linear bar of the familiar "C-channel" cross sectional shape having flat back 6 from which legs 4 depend to bracket channel, or front, 2 opposite back 6. Rail 3 further includes regularly spaced apertures 7 along the centerline of front 2 and back 6. Apertures 7 penetrate rail 3 and substantially match in shape the cross section of pickets 5, which emerge through rail 3 substantially perpendicular thereto. Though apertures 7 and pickets 5 are depicted in the figures as being circular, one having ordinary skill in the art will recognize that other cross sections, such as square, may be used and in fact are commonplace for pickets 5. Staking groove or mark 9 in front 2 immediately surrounds a portion of each picket 5 where rail 3 has been staked to picket 5.

Figure 3C:
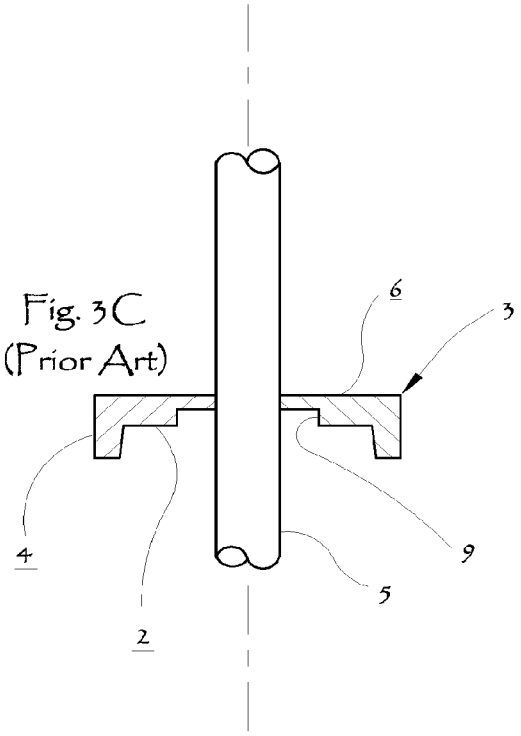
Fig. 3C (Prior Art)
FIGS. 3A, 3B and 3C depict in cross section the sequence of a typical staking operation.
Figure 3A:
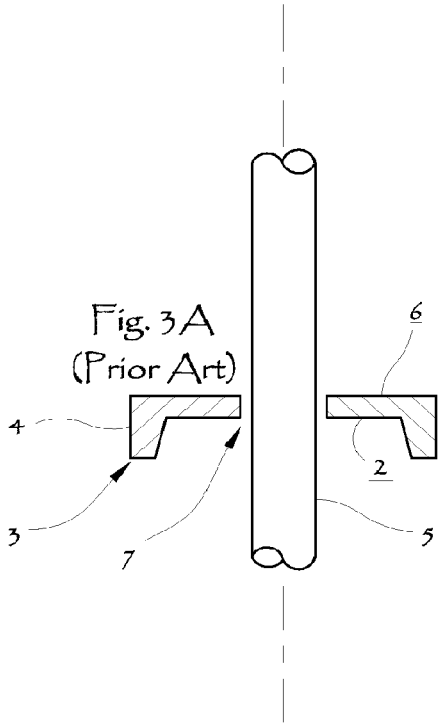
Fig. 3A (Prior Art)
Figure 3B:
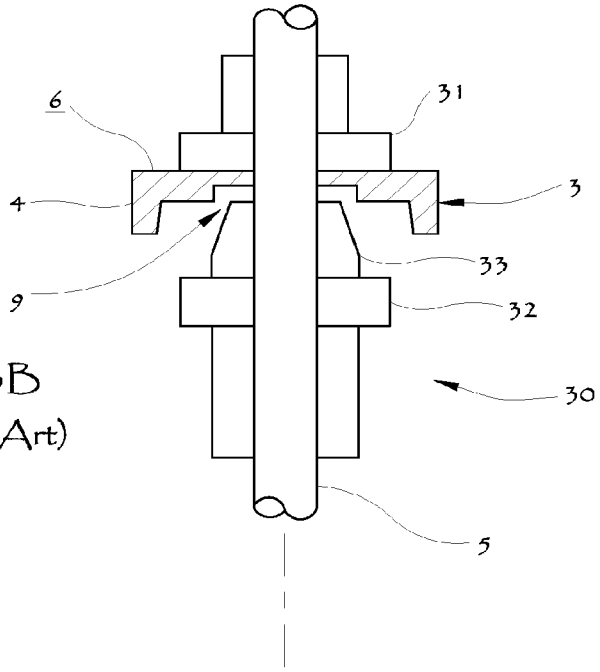
Fig. 3B (Prior Art)

FIGS. 3A, 3B and 3C demonstrate a staking operation that could produce panel 1. Though picket 5 closely fits aperture 7, space remains between its walls and the perimeter of picket 5 (FIG. 3A). Staking tool 30 (FIG. 3B) surrounds a portion of picket 5 during the staking operation. Tool 30 comprises staking die 32, a tapered section 33 having an interior shape matching the cross section of picket 5. Die 32 is adapted to fit against rail 3 near aperture 7 and to be driven or struck from behind to stake rail 3 to picket 5. Anvil die 31 is held against rail 3 opposite staking die 32 and resists the force upon staking die 32 during the staking operation. FIG. 3C shows a completed staking operation where tool 30 has been removed, leaving smooth staking mark 9 in the center of front 2 surrounding picket 5. Aperture 7 has been filled by metal material from front 2 (FIGS. 2, 3C) to crimp rail 3 to picket 5.

Staking tool 30 (dies 31, 32) conventionally would comprise hand held tools. Die 32 would be held by or embodied in a punch, and anvil 31 could be as simple as a block of iron with an aperture slightly larger than picket 5, both held in place manually or by a jig (not shown). A worker would sharply strike the rear of the punch (not shown) holding die 32 while another worker held anvil 31 to resist the impact of the first worker's blow. The workers would proceed one connection at a time until panel 1 had been completed.

Figure 4:
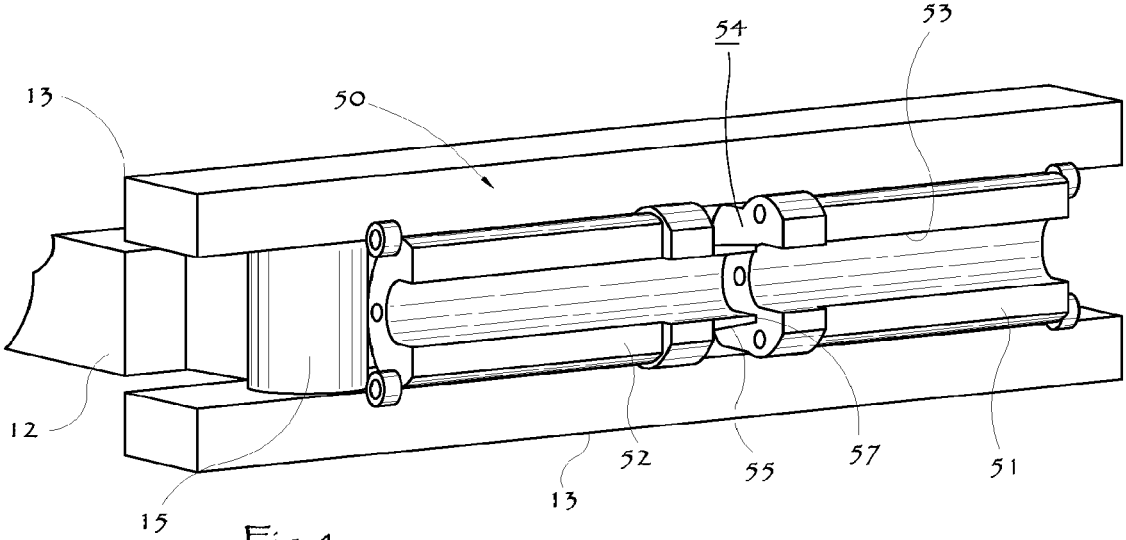
FIG. 4 details the staking dies of a preferred embodiment of the present invention.

Turning now to FIG. 4, staking die 50 of the present invention comprises forged steel, cylindrical dies 51, 52 each having a central, longitudinal groove 53 adapted to receive picket 5 prior to a staking operation. Grooves 53 embody a cross section and diameter matching that of pickets 5, and preferably extend around picket 5 as much as half of its perimeter, but no more. One having ordinary skill in the art will recognize that pickets 5 must nest fully within grooves 53, so that grooves 53 cannot exceed 180 degrees of the circumference of pickets 5. They could, however, extend less than the full 180 degrees of circumference without departing from the spirit and scope of the present invention. The minimum circumference which must be covered by dies 51, 52 for the present invention to perform properly is approximately one-third (⅓) of the total circumference.

Anvil die 51 comprises flat face 54 which presses against back 6 opposite front 2 in the immediate vicinity of aperture 7. Staking die 52 includes nose 55 having a relatively small face 57 which strikes or presses against front 2 in the immediate vicinity of aperture 7 opposite anvil die 51. Pressure against such a small surface area of front 2 as face 57 overcomes the plasticity barrier of the metal from which rail 3 is made. The metal flows under the pressure from face 57, and the only place it can go is into aperture 7. When die face 57 is removed, staking mark 9 has replaced aperture 7 and picket 5 is immobilized relative to rail 3.

Figure 5:
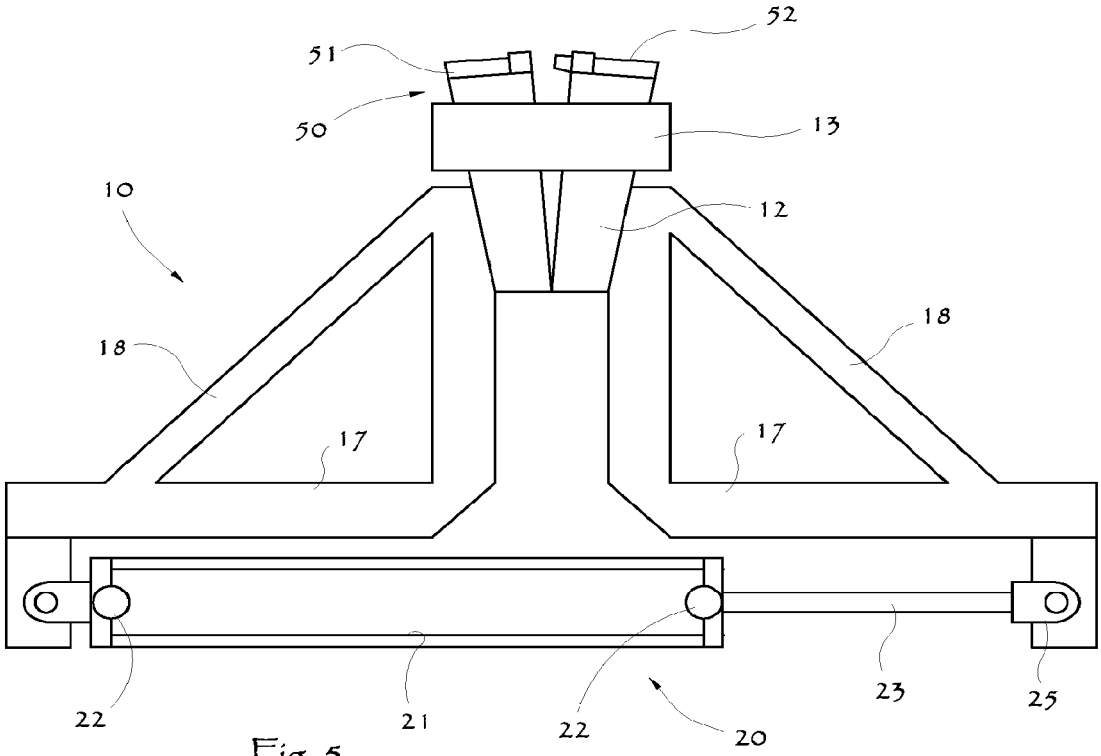
FIG. 5 shows a side view of a preferred embodiment of the present invention comprising a power tool adapted to employ the dies of FIG. 4 to perform a staking operation.

Turning now also to FIG. 5, power tool 10 produces a staking operation and staking marks 9 of FIG. 2, but without requiring the labor intensive, manual operation described above. Tool 10 holds die set 50 in coplanar mandibles 11, 12 in axial alignment astraddle picket 5, as discussed below. Right mandible 12 holds staking die 52 and left mandible 11 holds anvil die 51. Two parallel bridges 13 disposed on either side of mandibles 11, 12 include transverse pivot axes 15 about which mandibles 11, 12 rotate, thereby enabling mandibles 11, 12 to perform a scissoring rotation to urge dies 51, 52 toward each other. Mandibles 11, 12 are coupled to L-shaped arms 17, reinforced by diagonal braces 18, which extend substantially coplanar with mandibles 11, 12 to opposite ends of power cylinder 20.

Power cylinder 20 extends between arms 17 to operate mandibles 11, 12. Power cylinder 20 comprises hydraulic chamber 21 with reciprocating plunger 23. Hydraulic fluid lines 22 couple to chamber 21 and provide hydraulic pressure from a pump (not shown) to operate cylinder 20. A hydraulic switch (not shown) allows user 90 to control the displacement of plunger 23 and thereby to operate tool 10. Thus, by operating cylinder 20 to extend plunger 23 out of chamber 21, user 90 (see FIG. 6) urges dies 51, 52 toward each other with sufficient pressure to overcome the elasticity factor of the metal of rail 3, as discussed above.

Hydraulic cylinder 20 must be capable of exerting a power stroke of approximately five (5 t.) tons of force between arms 17 with a cycle frequency of six (6) operations per minute. Arms 17 amplify this force to approximately twenty (20 t.) tons for the staking force itself. A suitable hydraulic cylinder 20 is available as model number 214-320 from Bailey Manufacturing Corp. of Knoxville, Tenn. One having ordinary skill in the art will recognize that other power means may be substituted for hydraulic cylinder 20, such a pneumatic cylinder (not shown) or an electro-mechanical power train (not shown) without departing from the spirit and scope of the present invention, as long as such alternate power source is capable of providing at least as much stroke power and frequency as specified herein.

As best seen in FIG. 5, the longitudinal axes of staking dies 51, 52 are disposed at a slight, obtuse angle relative to each other substantially coplanar with mandibles 11, 12. With dies 51, 52 so spaced apart, rail 3 may be placed within the gap, with picket 5 in groove 53, in preparation of a power operation by cylinder 20. When cylinder 20 extends plunger 23, it pushes apart arms 17, causing mandibles 11, 12 to rotate about pivots 15 and urging dies 51, 52 toward each other in a long-radius arc. At the maximum stroke of cylinder 20, dies 51, 52 align co-axially with picket 5. At this position, staking die 52 is spaced apart from anvil die 51 a distance less than the thickness of rail 3 at front 2. Thus, rail material is compressed and must flow into aperture 7 and toward picket 5, crimping rail 3 against picket 5. The operation forms a strong attachment of picket 5 to rail 3.

Figure 6:
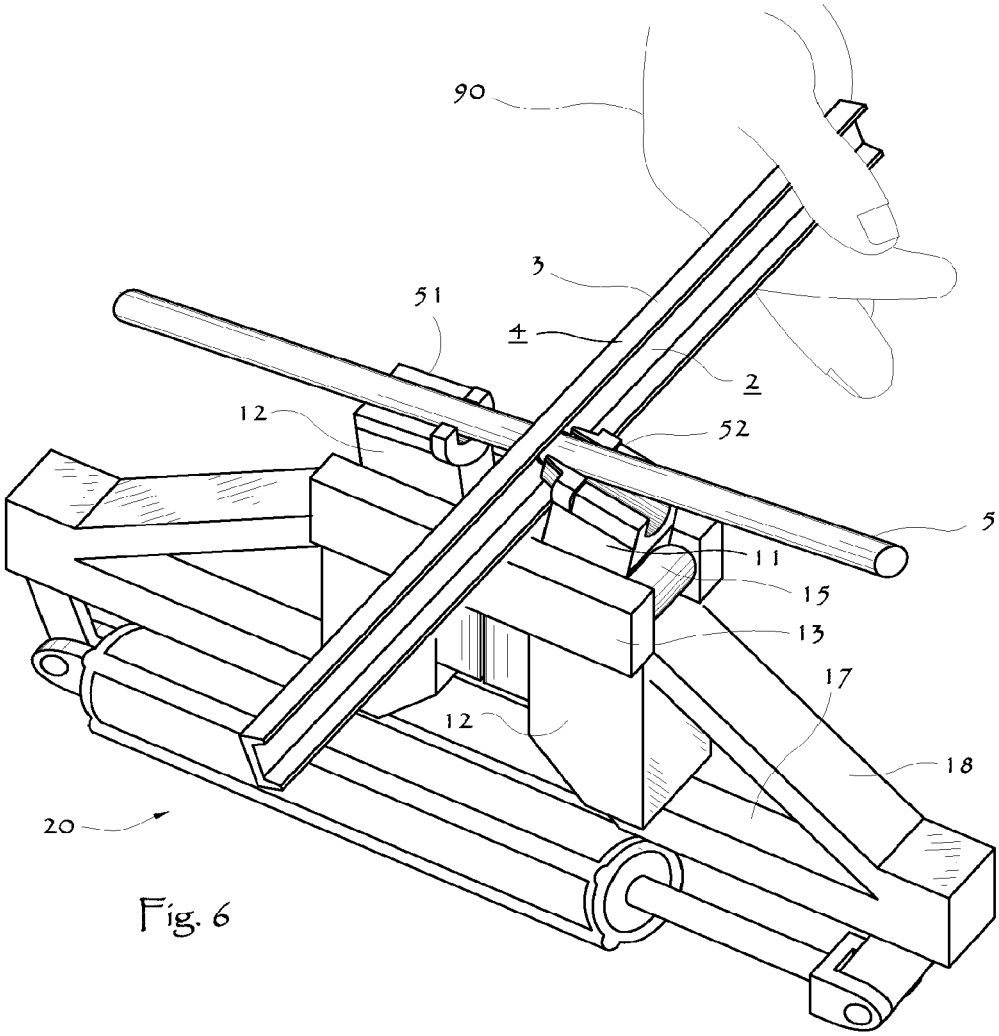
FIG. 6 shows a sample support rail and picket in place in the dies of FIGS. 4 and 5.

In operation, a single staking operation proceeds as exemplified by FIG. 6. User 90 prepares rail 3 and picket 5 for the staking operation. Apertures 7 have been introduced into front 2 of rail 3 along its centerline at the spacing desired for proper visual and functional effect of a fence (not shown) to be constructed from a plurality of panels 1. In FIG. 6, user 90 places rail 3 between mandibles 11, 12 transverse to and supported by bridges 13. User 90 further places picket 3 within grooves 53 of dies 51, 52 and extending through aperture 7. User 90 then operates hydraulic cylinder 20 for one power stroke, thus urging dies 51, 52 toward each other as described above. Rail 3 becomes crimped onto picket 5, leaving staking mark 9 on the bottom side of rail 3 in the center of rail front 2. Picket 5 is immobilized relative to rail 3.

Figure 7:
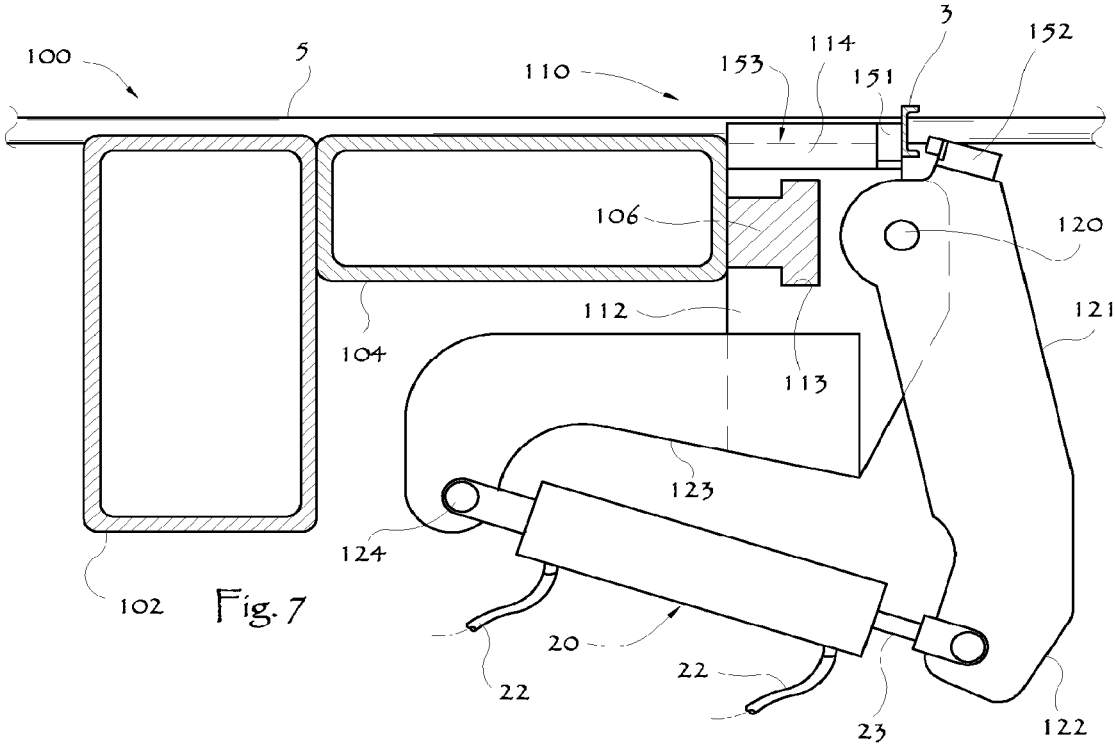
FIG. 7 shows an alternate embodiment of the present invention.
Figure 8:
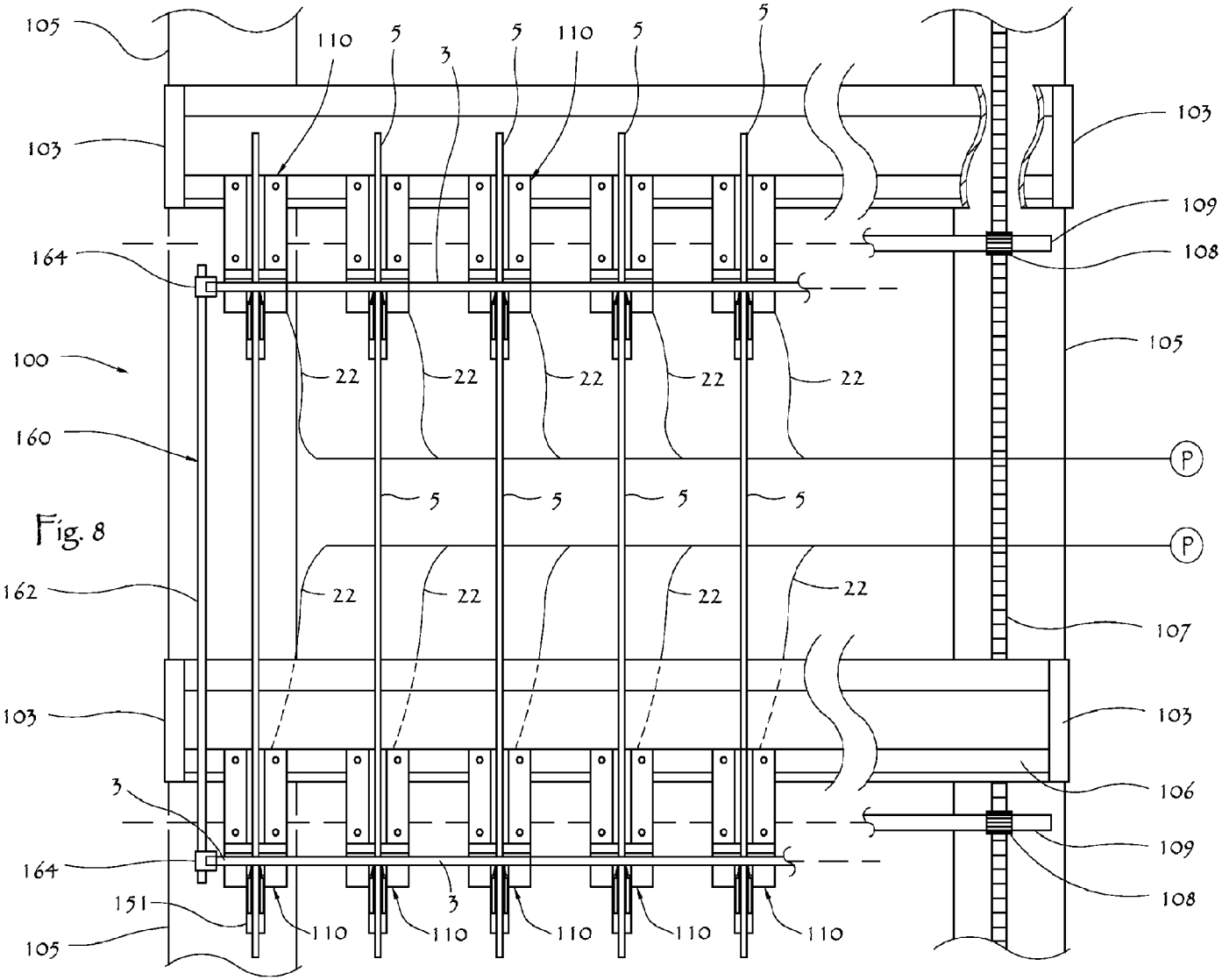
FIG. 8 shows a machine employing an array of the alternate embodiment of FIG. 7 to perform multiple staking operations simultaneously to create the panel depicted in FIG. 1.

FIGS. 7, 8 represent an alternate embodiment of the power tool of FIG. 5. Tool 110 comprises at each contact point between rail 3 and pickets 5 a set of staking dies 150 for rendering simultaneous staking operations on panel 1. Staking machine 100 comprises a plurality of bases 102 mounted through posts 103 onto at least two tracks 105 arrayed perpendicular to bases 102. Each track 105 is equipped with rack 107 and pinion gear 108, the latter of which turns on shaft 109 coupling tracks 105 together. Racks 107, pinions 108 and shafts 109 provide means for selecting and adjusting the separation of bases 102 to match the desired separation of rails 3 for a given panel 1. Means for turning shaft 109 to adjust separation of bases 102 may be included, such means being as simple as a plurality of releasable clamps (not shown), a crankshaft (not shown) on one or more of shafts 109, or as complex as electronically controlled motor drives with feedback loops for precise measurements of such separation. Base 102 supports horizontal bar 104 which further supports mounting truncheon 106 extending the length of bar 104.

Slidably journaled onto truncheon 106 at each staking point are tools 110 adapted to perform a single staking operation between one rail 3 and one picket 5. Tools 110 comprise a pair of pivot blocks 112 adapted to be affixed by set screws, clamps or other known affixing means (not shown) along the length of truncheon 106. Each pivot block 112 includes T-shaped bore 113 of like cross section to truncheon 106 and adapted to slidably receive truncheon 106 for mounting tool 110 to bar 104. By matching the spacing between tools 110 to the spacing of apertures 7 in rail 3, user 90 can determine with accuracy the proper spacing for pickets 5 for panel 1. Because tools 110 are movable, the spacing is selectable for different panels 1, or for different spacings within a single panel 1.

Fixedly mounted to the top of and spanning each pair of blocks 112, plate 114 holds them in fixed, spaced juxtaposition on truncheon 106. One end of plate 114 opposite bar 104 comprises anvil die 151 of staking die set 150. Die 151 receives picket 5 nested along its longitudinal groove 153 transverse to bar 104 and truncheon 106.

Pivotally mounted between two blocks 112 by axle 120, staking arm 121 bears staking die 152 at one end and gusset 122 at its other. Fixedly mounted between blocks 112 beneath and coplanar with staking arm 121, elongated elbow 123 extends beneath bar 104 to terminate in gusset 124. Disposed between gussets 122, 124, hydraulic cylinder 20 is adapted to provide the mechanical power for the staking operation. When hydraulic cylinder 20 is retracted, as depicted in FIG. 7, tool 110 is open and ready for loading rail 3 and picket 5 as shown.

Staking die 152 is disposed on the end of staking arm 121 coplanar with staking anvil die 151 and adapted to be pivoted into axial alignment therewith during a staking operation. As depicted in FIG. 7, however, staking die 152 is spaced apart from staking anvil die 151 to permit placement of rail 3 in between, just as was done in FIG. 6 with anvil die 51 and die 52. When hydraulic cylinder 20 operates to extend plunger 23, pivot arm 121 rotates about axle 120 to urge staking die 152 toward anvil 151 to stake rail 3 to picket 5.

As best seen in FIG. 8, multiple tools 110 arrayed on bar 104 are adapted to operate simultaneously to stake rail 3 to all pickets 5 along its length. Further, a second array of tools 110 on bar 104 is disposed along tracks 105 to provide simultaneous staking of a second rail 3 toward the other end of pickets 5, thereby creating panel 1 in a single operation of multiple hydraulic cylinders 20 by known means. To this end, a hydraulic control unit P is dedicated to and adapted to operate simultaneously a plurality of tools 110. Said hydraulic control unit P may be as simple as manually operated hydraulic valves (not shown) dedicated to each row of tools 110, or multiple such valves each dedicated to one tool 110 and tied together by an iron bar enabling simultaneous operation. Alternately, control unit P may comprise an electronically controlled series of actuators (not shown) including at least one pressure sensor (not shown) and adapted to operate tools 110 and to release tools 110 when they complete their compression strokes. One having ordinary skill in the art will recognize that all such types of control units P are considered within the spirit and scope of the present invention. Preferably, a single hydraulic control unit P controls a single row of tools 110 staking pickets 5 to one rail 3 of panel 1, with additional hydraulic control units P dedicated to other rails 3 on panel 1, but tied together by a common switch to allow simultaneous operation.

In operation, machine 100 first must be set up for the size and spacing needed for panel 1. Bars 104 are selected by number and spaced apart using racks 107 and pinions 108, as shown in FIG. 8. One having ordinary skill in the art will recognize that the number and spacing of bars 104 will determine the number and spacing of rails 3 in panel 1. Next, the number and spacing of pickets 5 along rails 3 is determined, and sets of staking tools 110 are arrayed along each bar 104 according to such spacing. One having ordinary skill in the art will recognize that not all pickets 5 may be staked to every rail 3 in such array. For example, where three rails 3 are arrayed for a panel (not shown), alternating pickets 5 may extend only through two of rails 3 instead of all three for an aesthetically desirable result. Tools 110 are then affixed along bars 104 as needed for staking rails 3 to pickets 5.

Simultaneously crimping rails 3 at multiple points along their length to pickets 5 can cause panel 1 to acquire a slight vertical arc toward fronts 2 of rails 3. Crimping pickets 5 one at a time does not produce this result because each time a crimp is formed, measurements are made anew before crimping. Accordingly, a step in the fabrication process is needed to avoid this potential problem. Prior to inserting them into tool 110, rails 3 are run through a set of rollers (not shown) which induce a gentle, reverse curvature to rails 3. Said reverse curvature causes them to arc away from their fronts 2 and induce a concave arc in backs 6. The reverse curvature is slight enough that it does not substantially affect negatively insertion of rails 3 into tool 110. Preferably, said reverse curvature produces no more than a six (6") inch displacement of one end of rail 3, from a tangent thereof taken at its opposite end, for an eight (8') foot length of rail 3.

Rails 3 next are laid on their legs 4 on an assembly table in parallel juxtaposition and spaced apart a distance approximating the required rail spacing for panel 1, with their front sides 2 facing the same direction. A jig 160 preferably is placed on both ends of rails 3 to retain such spacing and to make handling of an assembled but unstaked panel 1 while inserting it into tool 110. Jig 160 comprises a plurality of sockets 164, one for each rail being used in panel 1, each socket 164 sized and shaped to fit the end of a rail 3. Sockets 164 are coupled to spacer bar 162 at the spacing of rails 3 anticipated for panel 1. Securing rails 3 to jig 160 substantially spaces apertures 7 in rail 3 so that they are roughly aligned.

In preparation for insertion into panel 1 within tools 110, pickets 5 must be prepared in advance for the staking operation. For example, pickets 5 may or may not include finials 8 (FIG. 1) on their upper end for decoration and aesthetic appearance of panel 1. If finials 8 are to be included for panel 1, pickets 5 preferably first are prepared for insertion into machine 100 by installing such finials 8. Other pre-staking operations may include twisting pickets 5, especially pickets 5 with square cross sections (not shown) to induce a decorative spiral (not shown) to their perimeter for at least some portion of their length.

Once pickets 5 are so prepared, they next are inserted through rails 3 as needed for the design of panel 1, with care being taken to match the height and alignment of the ends thereof. Panel 1 then may be lifted by jigs 160 and placed into machine 100. Each rail 3 is carefully placed between staking dies 151, 152 within each tool 110 on machine 100 such that its legs 4 extend toward staking die 152, with one leg 4 resting on blocks 112. With panel 1 so placed, pickets 5 should lay within grooves 153 of dies 151, 152. Jigs 160 then may be removed from rails 3, leaving assembled but unstaked panel 1 positioned in machine 100 and substantially ready for a staking operation.

During the staking operation, tools 110 may not operate in perfect synchronicity, thus possibly staking pickets 5 to rails 3 at random intervals. If left uncontrolled, this can lead to pickets 3 individually migrating within machine 100 and becoming mis-aligned one with another along panel 1. Preferably, then, retaining blocks (not shown) are placed between the ends of pickets 3 to stabilize them within machine 100. As mentioned above, where pickets 3 are not all of the same length, or where they protrude to different lengths above the highest rail 3 or panel 1, such retaining blocks align either their top or bottom, or both, to assure the aesthetic appearance desired for panel 1. Such retaining blocks also discourage unwanted movement of panel 1 when machine 110 releases all tools 110 after a staking operation.

Once panel 1 is set within machine 100 and stabilized with any necessary blocks, user 90 operates a single control (not shown) of known means to simultaneously operate all power cylinders 20 on tools 110 to stake panel 1. Preferably, said single control operates separate hydraulic sources for each rail 3, with all tools 110 driven by the same hydraulic sources. One having ordinary skill in the art will recognize that the need for separate hydraulic sources depends upon the length of panel 1 and the number of pickets 5 to be included therein.

Once all tools 110 all have operated and appear to have stopped, user 90 visually verifies that all tools 110 have reached their maximum compressive stroke and uniformly staked all pickets 5 to rails 3. User 90 may tap each of rails 3 lightly with a mallet or hammer (not shown) to assure that no unwanted stresses induced into rails 3 will cause it to spring out of machine 100 hazardously when released. Once user 90 is satisfied with the operation, he then releases cylinders 20 and lifts completed panel 1 from machine 100 for further processing, such as installation of mounting brackets and finishing.

The present invention, described in either its preferred or alternate embodiment, thus serves to create single and multiple clean, crisp, aesthetically desirable stakings of pickets 5 to rails 3. Machine 100 employs multiple staking tools 110 to perform simultaneously as many staking operations as necessary to create panel 1 in one operation. This dramatically decreases the time necessary to create panel 1, thus considerably enhancing the efficiency of fence fabrication operations. For example, operating at limited capacity, machine 100 has been used to produce 1000 feet of fence panels 1 within a single day using untrained labor, whereas it would take approximately a week to produce the same results using traditional methods, including welding. In its single mode embodiment of FIG. 5, tool 10 can be used to repair existing fences in the field using the present invention.

While the invention has been particularly shown and described with reference to one or more embodiments, it will be understood by those skilled in the art that various changes in form and detail may be made therein without departing from the spirit and scope of the invention. For example, the first preferred embodiment has been depicted as using a powered stroke from hydraulic cylinder 20 to stake picket 5 to rail 3, but sufficient power could be provided by lever arms mounted directly to arms 17 and adapted to allow user 90 to compress die set 50 as he would a crimping tool or bolt cutter.

Further, tools 10, 110 have been described above as operations of mandibles which pivot about an axle, with arms 17, 122, 123 which amplify forces from cylinders 20. Tools 10, 110 also could utilize straight push cylinders which do not rely on leverage from arms 17, 122, 123.

Still further, staking could be achieved with a hammering operation induced by motor driven cams (not shown) driving staking dies 52, 152 against anvils 54, 154 without using cylinders 20 at all. Such hammering operation could be done with a single, large blow or multiple small blows, that overcome the deformation threshold of rails 3. A single, sharp blow of eighteen (18 t.) tons will drive staking dies 52, 152 through rails 3.

Also, though machine 100 has been described above as utilizing straight (though slightly reversed curved) rails 8 to produce panels 1 having substantially parallel upper and lower rails 3, one or more of rails 3 could be curved for a desired aesthetic effect. In such case, depending upon the degree of curvature of rails 3, staking dies 151, 152 may include faces 154, 157 which angle slightly relative to pickets 5 to better engage rails 3 at their contact points along such curvature.

Also, jig 160 was mentioned above only in conjunction with panel 1 assemblies for simultaneous staking using machine 100, but of course jig 160 equally may be useful for single operations using tool 10.

Finally, the invention has been discussed in detail with relation to C-channel shaped rails 3 common in the United States, but the invention works equally well with other shaped rails 3 such as flat bar (not shown) comprising essentially back 6 without legs 4, which flat bar is commonly used in Europe.

I claim:

1. A fence panel staking machine, the fence panel having vertical metal pickets staked to a plurality of transverse metal rails, each rail having an upper back and a lower front, the staking machine comprising at least one staking tool having a pair of mandibles, each mandible having a die end and a lever end and pivotally mounted between the mandible ends to a common block;

first and second dies, each disposed on the die end of one of the mandibles and having a central groove adapted to receive a single picket;

a substantially planar anvil disposed on one end of the first die and adapted to engage the rail back;

a staking head disposed on the second die and adapted to engage the rail front opposite the anvil;

power means coupled to the staking tool for providing power for a staking operation.

2. The fence panel staking machine according to claim 1 wherein the power means comprises one lever arm coupled to each lever end of the mandibles and adapted to be moved relative to each other to urge the dies together.

3. The fence panel staking machine according to claim 1 wherein the power means comprises a hydraulic cylinder coupled between the lever ends of the mandibles opposite the dies; and control means for operating the hydraulic cylinder.

4. The fence panel staking machine according to claim 1 wherein the staking head further comprises a nose tapering from the second die toward the anvil and terminating distal the second die in a narrow face adapted to surround a portion of the picket.

5. The fence panel staking machine according to claim 1 and further comprising a rail staking assembly having a lateral mounting truncheon disposed parallel to the rails; and a plurality of staking tools spaced along the truncheon at each picket.

6. The retrieval tool according to claim 5 wherein the power means comprises hydraulic cylinders coupled between the lever arms opposite the dies of each staking tool; and control means for simultaneously controlling the hydraulic cylinders to stake all pickets along the rail in a single staking operation.

7. The fence panel staking machine according to claim 5 and further comprising a plurality of rail staking assemblies, one for each rail, disposed parallel to each other;

a plurality of tracks coupled between the staking assemblies, each track having a rack gear disposed along its length; and a pinion gear engaged with the rack and journaled on a shaft extending between the tracks; and shaft rotating means for rotating the shaft to turn the pinion gear and move one rail staking assembly relative to another.

8. The fence panel staking machine according to claim 7 wherein the power means comprises hydraulic cylinders coupled between the lever ends of the mandibles dies of each staking tool; and control means for simultaneously controlling the hydraulic cylinders to stake all pickets along all of the rails in a single staking operation.

9. A fence panel staking machine, the fence panel having vertical pickets staked to a plurality of transverse rails, each rail having an upper back and a lower front, the staking machine comprising a plurality of rail staking assemblies, one for each rail, disposed parallel to each other and having a lateral mounting truncheon disposed parallel to the rails; and a plurality of staking tools spaced along the truncheon at each picket, each staking tool having a pair of mandibles, each having a die end and a lever end and pivotally mounted between the mandible ends to a block;

first and second dies, each disposed on the die end of one of the mandibles and having a central groove adapted to receive a single picket;

a substantially planar anvil disposed on one end of the first die and adapted to engage the rail back; and a staking head disposed on the second die and adapted to engage the rail front opposite the anvil; and power means coupled to the staking tools for providing power for a staking operation; and a plurality of tracks coupled between the staking assemblies, each track having a rack gear disposed along its length; and a pinion gear engaged with the rack and journaled on a shaft extending between the tracks; and shaft rotating means for rotating the shaft to turn the pinion gear and move one rail staking assembly relative to another.

10. The fence panel staking machine according to claim 9 wherein the power means comprises a hydraulic cylinder coupled between the lever ends of the mandibles of each staking tool; and control means for simultaneously controlling all hydraulic cylinders to stake all pickets along all of the rails in a single staking operation.

11. An improved method of fabricating a fence panel, the fence panel having vertical metal pickets staked to a plurality of transverse metal rails spaced apart along the pickets, each rail having an upper back and a lower front, the method comprising providing a fence staking machine having at least one staking tool, each staking tool having a pair of mandibles, each having a die end and a lever end and pivotally mounted between the mandible ends to a block;

first and second dies, each disposed on the die end of one of the mandibles and having a central groove adapted to receive a single picket;

a substantially planar anvil disposed on one end of the first die and adapted to engage the rail back side;

a staking head disposed on the second die and adapted to engage the rail front opposite the anvil;

power means coupled to the staking tool for providing power to urging the first and second dies together for a staking operation; and assembling an unstaked fence panel by selecting a plurality of rails; then punching a plurality of apertures at a selected picket spacing along said rails for pickets; then placing a plurality of rails parallel one another and held in place by a jig; then inserting one picket through each of the apertures in the rails and aligning the ends of said pickets; then staking the pickets to the rails using the staking tool.

12. The improved method of claim 11 wherein the staking step further comprises the steps of (a) placing the rails into the staking tool with one picket within the central groove; then (b) operating the power means to stake the picket to the rail; then repeating steps (a) through (b) for each picket in each rail.

13. The improved method of claim 11 wherein the providing step further comprises providing at least one lateral mounting truncheon disposed parallel to the rails; and a plurality of staking tools spaced along the truncheon at each picket.

14. The improved method of claim 13 wherein the staking step further comprises the steps of (a) placing a rail into the staking tools along the truncheon with one picket within the central groove of each staking tool; then (b) operating the power means to stake each picket to the rail in a single operation; then repeating steps (a) through (b) for each rail in the fence panel.

15. The improved method of claim 14 wherein the assembling step further comprises the step of inducing a reverse curvature into the rails before the placing step such that their backs are slightly concave along their longitudinal length.

16. The improved method of claim 13 wherein the providing step further comprises providing a mounting truncheon for each of the rails; and the staking step further comprises the steps of (a) placing each rail into the staking tools along one of the truncheons with one picket disposed within the central groove of each staking tool; then (b) removing the jig; then (c) operating the power means to stake each picket and all of the rails in a single operation.

17. The improved method of claim 16 wherein the assembling step further comprises the step of inducing a reverse curvature into the rails before the placing step such that their backs are slightly concave along their longitudinal length.

18. The improved method of claim 16 wherein the providing step further comprises providing a plurality of shafts, each disposed parallel to one of the truncheons;

a plurality of tracks coupled between the truncheons, each track having a rack gear disposed along its length; and a plurality of pinion gears engaged with the rack gear and journaled on one of the shafts; and shaft rotating means for rotating the shafts to turn the pinion gears and move one or more of the truncheons relative to the other truncheons; and prior to the staking step, operating the shaft rotating means to adjust the spacing between truncheons to match the rail spacing for the fence panel.

19. The improved method of claim 18 wherein the assembling step further comprises the step of inducing a reverse curvature into the rails before the placing step such that their backs are slightly concave along their longitudinal length.

20. An improved method of fabricating a fence, the fence having a plurality of fence panels coupled end to end and supported by posts, each fence panel having vertical metal pickets staked to a plurality of transverse metal rails supported by the posts and spaced vertically apart along the pickets, each rail having an upper back and a lower front, the method comprising providing a fence staking machine having at least two tracks disposed parallel to each other and bearing rack gears;

a plurality of shafts disposed transverse the tracks and having a pinion gear engaged with each rack gear;

a plurality of truncheons disposed transverse the tracks at a selected rail spacing, the truncheons coupled to the shafts;

a plurality of staking tools disposed along the truncheons at a selected picket spacing, each staking tool having a pair of mandibles, each having a die end and a lever end and pivotally mounted between the mandible ends to a block, the block mounted to the truncheon;

first and second dies, each disposed on the die end of one of the mandibles and having a central groove adapted to receive a single picket;

a substantially planar anvil disposed on one end of the first die and adapted to engage the rail back;

a staking head disposed on the second die and adapted to engage the rail front opposite the anvil; and power means coupled to the staking tool for providing power to urging the first and second dies together for a staking operation; and assembling an unstaked fence panel by selecting a plurality of rails; then punching a plurality of apertures at the selected picket spacing along said rails; then inducing a reverse curvature into the rails before the placing step such that their backs are slightly concave along their longitudinal length; then placing the rails parallel one another at the selected rail spacing and installing a jig on their ends to hold them in place; then inserting one picket through each of the apertures and aligning the ends of said pickets; then placing the entire assembled but unstaked fence panel in the fence staking machine by placing each rail into the staking tools along one of the truncheons with one picket disposed within the central groove of each staking tool; then blocking the picket ends to keep them aligned; and removing the jig; then operating the power means to stake each picket and all of the rails in a single operation.

* * * * *